US006769839B2

(12) United States Patent
Elson

(10) Patent No.: US 6,769,839 B2
(45) Date of Patent: Aug. 3, 2004

(54) STERN-ON MOORING BOAT LIFT

(75) Inventor: Todd A. Elson, Claremore, OK (US)

(73) Assignee: HydroHoist International, Inc., Claremore, OK (US)

( * ) Notice: Subject to any disclaimer, the term of this patent is extended or adjusted under 35 U.S.C. 154(b) by 0 days.

(21) Appl. No.: 10/413,121

(22) Filed: Apr. 14, 2003

(65) Prior Publication Data

US 2003/0175107 A1 Sep. 18, 2003

Related U.S. Application Data

(63) Continuation of application No. 09/805,850, filed on Mar. 14, 2001, now Pat. No. 6,547,485.

(51) Int. Cl.[7] ..... B63C 1/02
(52) U.S. Cl. ..... 405/3; 114/45; 114/48
(58) Field of Search ..... 114/44, 45, 48, 114/263; 405/1, 3, 4, 7

(56) References Cited

U.S. PATENT DOCUMENTS 5,394,814 A * 3/1995 Rutter et al. ..... 114/45
6,076,478 A * 6/2000 Siegmann ..... 114/45

* cited by examiner

*Primary Examiner*—Heather Shackelford
*Assistant Examiner*—Sunil Singh
(74) *Attorney, Agent, or Firm*—Frank J. Catalano

(57) ABSTRACT

In a lift for mooring a boat stern-on, a pair of horizontally spaced guide members is fixed to the sea wall. A frame is fixed to a pair of substantially parallel hydro-pneumatic buoyancy tanks to provide a flotation platform for supporting the hull of the boat. The stern end of each of the tanks is connected to the guide members. The guide members limit movement of the platform away from the sea wall and along the sea wall but permit vertical reciprocation of the stern ends of the lift tanks in unison and restrict the lift from listing during operation.

8 Claims, 4 Drawing Sheets

STERN-ON MOORING BOAT LIFT

This application is a continuation of application Ser. No. 09/805,850, filed Mar. 14, 2001 (now U.S. Pat. No. 6,547,485).

BACKGROUND OF THE INVENTION

Boat lifts are presently available for side-mooring and bow mooring boats to a sea wall or dock. While stern-mooring of a boat on a lift would be very convenient for boarding and disembarkment, stern-moored boat lifts are not presently known. The motion and positioning of side and bow mooring lifts during operation prevent their use for stern mooring.

Side mooring lifts cannot be used for stern mooring because during operation, their motion is controlled by guides connecting the lift to the sea wall or dock both fore and aft. As the lift is operated, the bow and stern do not move together. During lowering, air is initially evacuated from one end of the lift tanks as water enters the other end, causing the lift to displace angularly downwardly about the air outlet end. As the water volume in the tank increases, the air outlet end also lowers and the tank returns to a level condition. The process is reversed when the lift is raised. To accommodate this angular motion, the guide components connecting the lift to the sea wall or dock are constructed to function independently so that the portion of the lift connected to the sea wall or dock is free to reciprocate independently. A stern-moored lift cannot be permitted to displace angularly or list on its guide components. The guide components must work in unison with each other to maintain the lift in a laterally level condition while the bow and stern each displace angularly.

Bow mooring lifts cannot be used for stern mooring either. They are generally pivoted at the sea wall or dock so that the bow end remains elevated while the stern end is lowered to receive the boat, bow first. Consequently, if bow mooring lifts were used for stern mooring, the aft portion of the boat, and especially the propeller, would strike the bow end of the lift.

It is, therefore, an object of this invention to provide a boat lift for stern mooring boats to sea walls and docks. Another object of this invention is to provide a boat lift having stern mounted guides for controlling the operational motion of the lift. A further object of this invention is to provide a boat lift having guide components which limit lateral movement of the lift in relation to the sea wall or dock. Yet another object of this invention is to provide a boat lift having guide components which, when stern mounted to the sea wall or dock, allow the stern to move freely vertically in relation to the sea wall or dock. It is also an object of this invention to provide a boat lift having stern mounted guide components which function to allow vertical reciprocation of the stern portions of the lift tanks in unison with each other.

SUMMARY OF THE INVENTION

In accordance with the invention, a lift for mooring a boat stern-on to a sea wall or dock is provided. A pair of horizontally spaced guide members fixed to the sea wall extend from the sea wall to a vertical plane parallel to the sea wall. A pair of substantially parallel hydro-pneumatic buoyancy tanks are symmetrically spaced from a vertical plane which is perpendicular to the parallel plane and extends substantially midway between the guide members. A frame is fixed to the tanks to provide a flotation platform for supporting the hull of the boat. The keel of the boat is received substantially aligned with the perpendicular plane and the stern of the boat is received at the stern end of the platform near the sea wall. Each of the tanks is connected to the guide members. The guide members limit movement of the platform away from the parallel plane or sea wall and away from the perpendicular plane or laterally along the sea wall. The guide members also operate in unison to restrict the lift from listing during operation.

In one preferred embodiment, a pair of horizontally spaced vertical tracks are fixed to the sea wall proximate their upper ends. They extend from the sea wall to a vertical plane parallel to the sea wall. A pair of slides are each fixed at one end to the stern ends of each of the tanks. They each engage and ride at their other end on the tracks. The slides limit movement of the platform away from the parallel plane or sea wall and away from the perpendicular plane or laterally along the sea wall while permitting the stern of the platform to reciprocate in unison vertically along the tracks. Preferably, the slides have pivoting linkages facilitating vertical displacement of the tanks relative to the guide members and restricting lateral displacement of the tanks relative to the guide members. The pivoting linkages each preferably have a clevis fixed to the slide, a bracket fixed to the tank and a link pivotally connected at one end to the clevis and at the other end to he bracket,. The links are formed from elastomeric material. The tracks are I-beams with their webs disposed in the vertical plane. The slides are members of C-shaped cross-section engaged on flanges of the I-beams. An anchor may optionally be disposed on the sea floor forward of the tanks and substantially aligned on the perpendicular plane. A line connected between the anchor and the bow portion of the platform at substantially the mid-point between the tanks limits movement of the bow end of the platform away from the perpendicular plane or laterally along the sea wall.

In another preferred embodiment, a pair of horizontally spaced rings fixed to the sea wall extend from the sea wall to the vertical plane parallel to the sea wall. An anchor is disposed on the sea floor forward of the tanks with a line connecting the anchor to the bow portion of the platform. One pair of lines is connected between each of the rings and the bow end of its corresponding tank. A second pair of lines may also be connected between each of the rings and the stern end of its opposite tank or between each of the rings and the opposite sides of the stern of the boat. The anchor line and the first pair of lines limit movement of the platform toward and away from the parallel plane or sea wall and laterally along the sea wall while permitting the stern of the platform to reciprocate vertically in unison along the tracks. The second pair of lines assist in restricting lateral movement of the platform along the sea wall when the lift is not in operation but must be cast off before operation of the lift.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
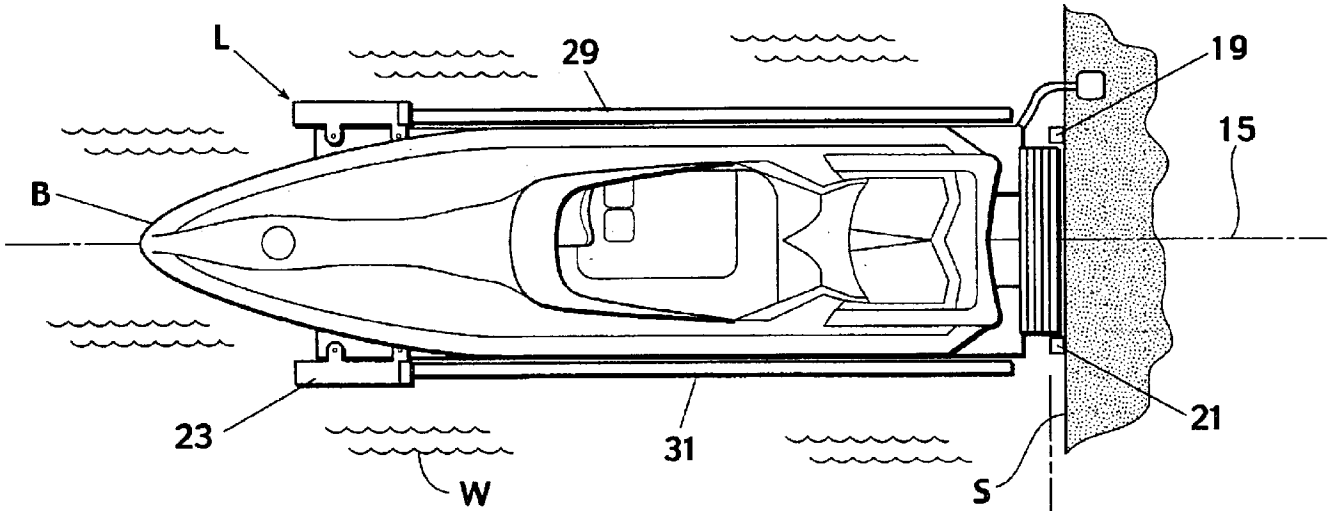
FIG. 1 is a top plan view of a preferred embodiment of the stern-on lift with a boat on the lift.
Figure 3:
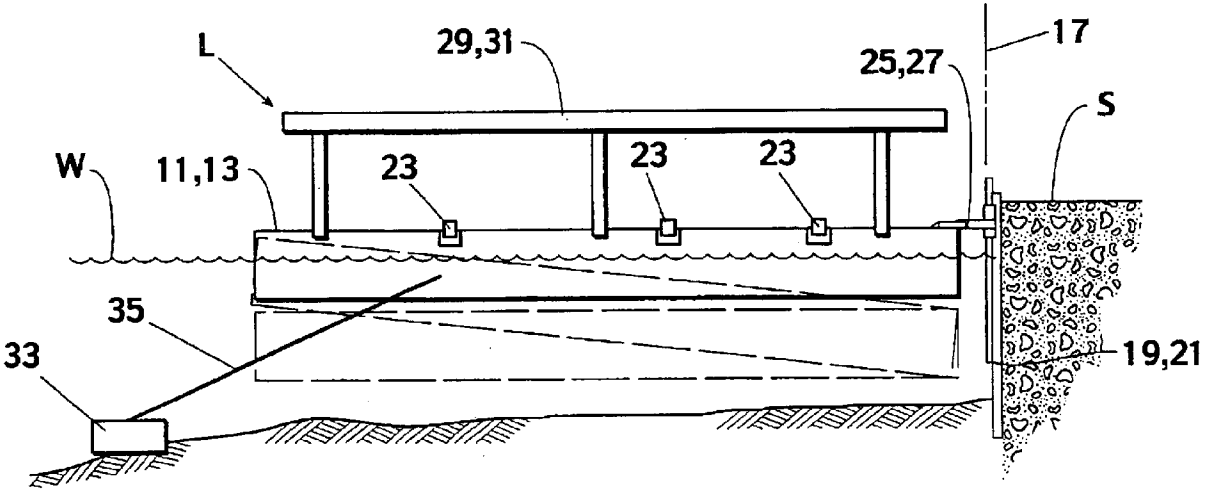
FIG. 3 is a side elevation view of the lift of FIG. 1 in the raised condition.
Figure 2:
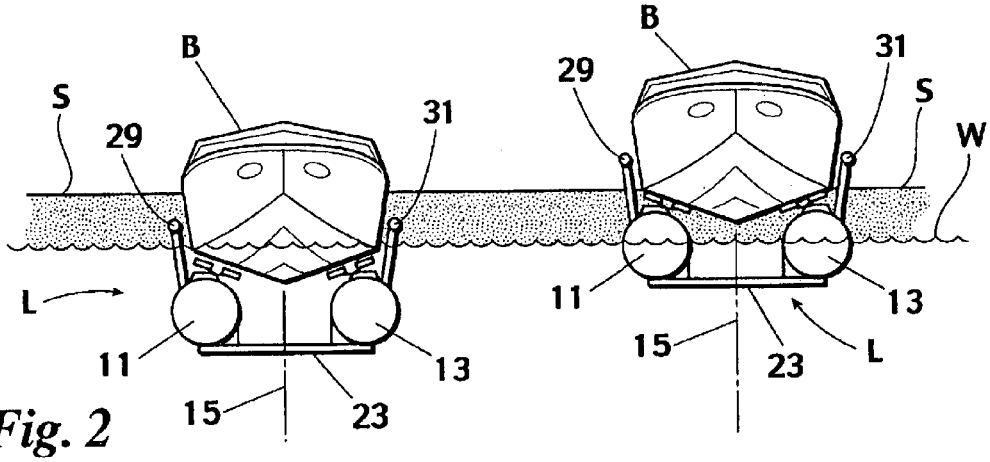
FIG. 2 is a front elevation view of the lift and boat of FIG. 1 in both lowered and raised conditions.

Turning first to FIGS. 1–3, a lift L for stern-mooring a boat B to a sea wall S is illustrated. As seen in FIG. 2, when the lift L is in its fully lowered condition, the lift L is substantially level and the boat B floats freely on the water W. When the lift is in its fully raised condition, the lift L is substantially level and the boat B is supported by the lift L entirely out of the water W. In the operation of the lift L, to lower the lift L, water is admitted to the stern end of the hydropneumatic tanks as air is evacuated from the bow end of the tanks. As seen in FIG. 3, the lift L is lowered stern end first while the bow end remains elevated. The bow end then sinks until the lift L is substantially level.

The lift flotation platform consists of a pair of substantially parallel hydropneumatic buoyancy tanks 11 and 13 which are symmetrically spaced from a vertical plane 15 which is perpendicular to another vertical plane 17 which is in turn parallel to the sea wall S. As a point of reference, the perpendicular plane 15 extends substantially midway between a pair of guide members 19 and 21 which are horizontally spaced apart and fixed to the sea wall S and extend from the sea wall S to the parallel vertical plane 17. A frame 23 fixed to the tanks 11 and 13 supports the hull of the boat B with the keel of the boat B substantially aligned with the perpendicular plane 15 and the stern of the boat B at the stern end of the lift L. A pair of connectors 25 and 27 connect the stern end of each of the tanks 11 and 13 to their respective guide members 19 and 21 to limit movement of the lift L away from the parallel plane 17 or sea wall S and to limit movement of the lift L away from the perpendicular plane 15 or laterally in relation to the sea wall S. The connectors 25 and 27 also permit the stern ends of the tanks 11 and 13 to move vertically in unison relative to guide members 19 and 21. A pair of floats 29 and 31 fixed to and extending above and parallel to the tanks 11 and 13 limit the depth to which the lift L is lowered. An anchor 33 disposed on the sea floor forward of the tanks 11 and 13 and substantially aligned on the vertical plane 15 is connected by a line 35 to the bow portion of the lift L at substantially a midpoint between the tanks 11 and 13 so as to assist in restricting movement of the lift L toward the parallel plane 17 or sea wall S and away from the perpendicular plane 15 or along the sea wall S.

Figure 4:
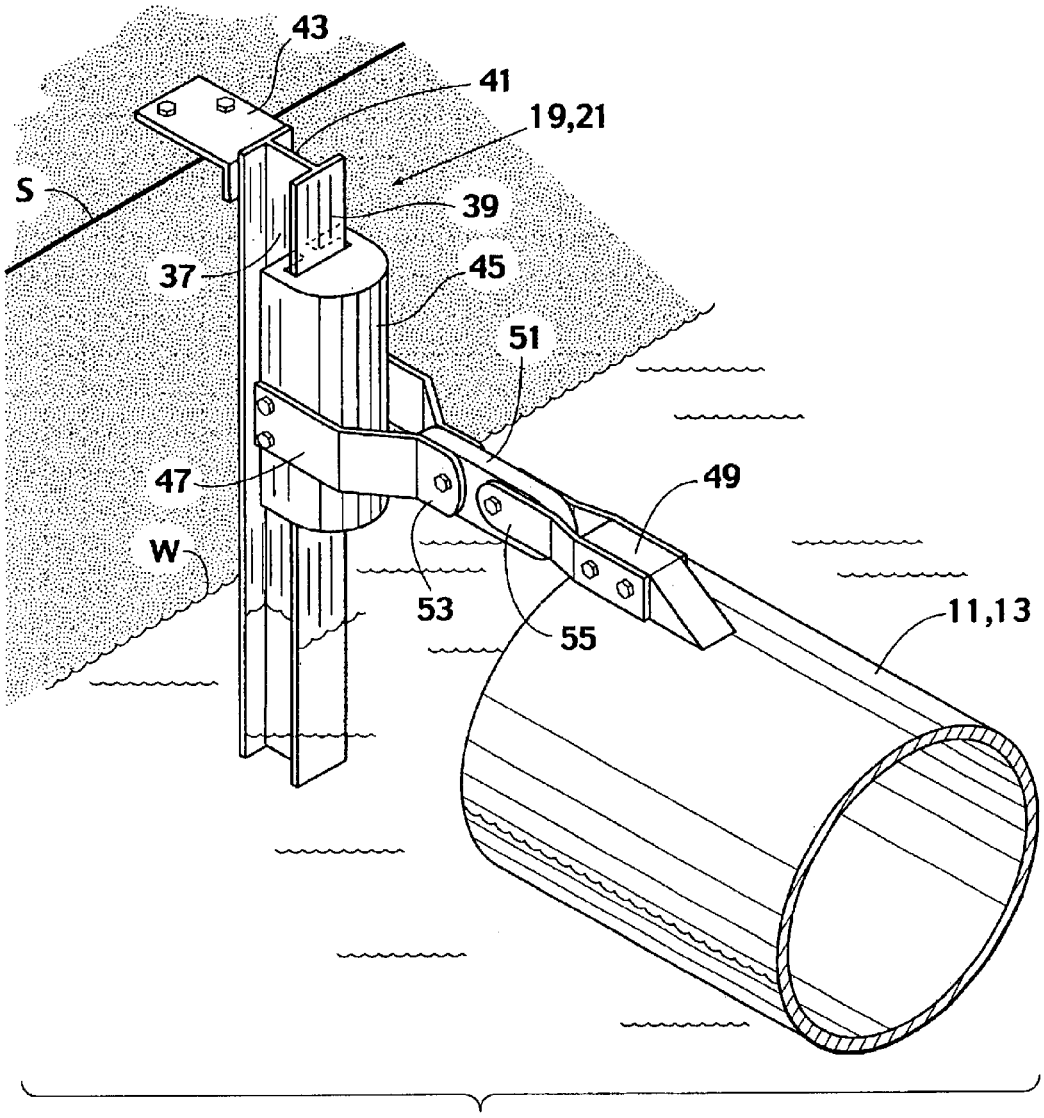
FIG. 4 is a perspective view of a preferred embodiment of guide member of the lift of FIG. 1.
Figure 6:
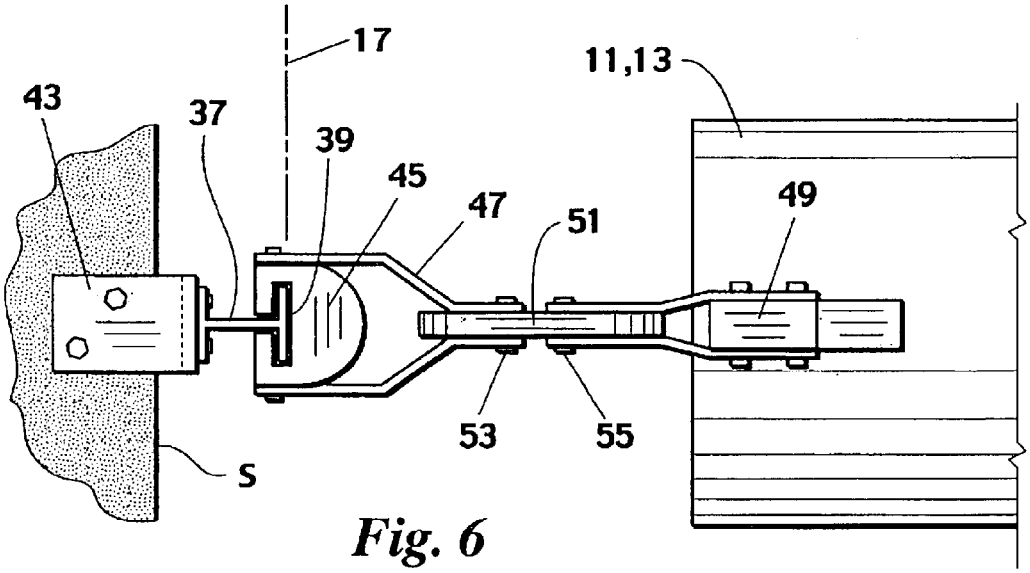
FIG. 6 is a top plan view of the guide member of FIG. 4.
Figure 5:
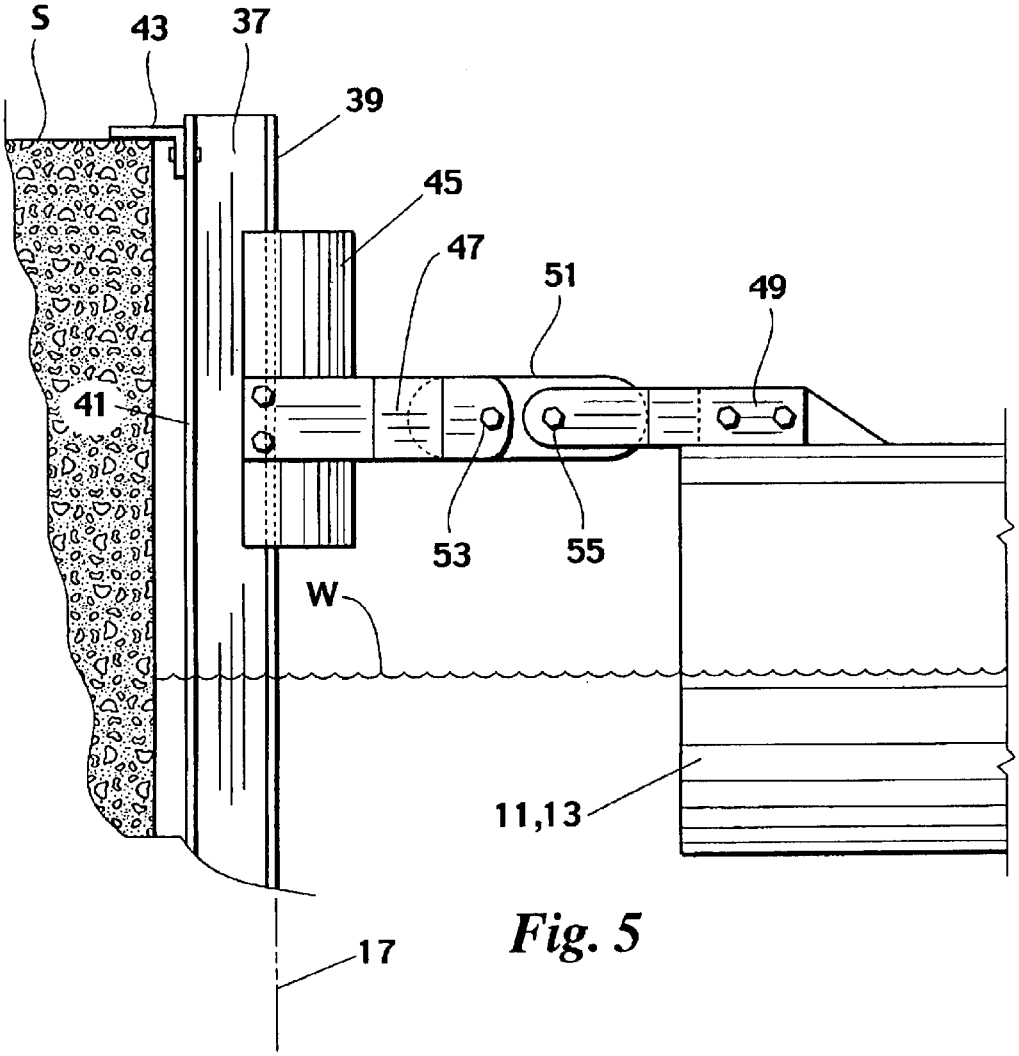
FIG. 5 is a side elevation view of the guide member of FIG. 4.

Turning to FIGS. 4, 5 and 6, the guide members 19 and 21 and the connectors 25 and 27 are shown in greater detail. In the preferred embodiment shown in FIGS. 4, 5 and 6, the guide members 19 and 21 consist of I-beams having their webs 37 parallel to the vertical plane 15 and their front flanges 39 lying in the parallel plane 17. The rear flanges 41 are fastened proximate their upper ends by brackets 43 to the sea wall S. The lower ends of the guide members 19 and 21 are sunk into the sea floor. A slide 45 is engaged on and rides on the front flange 39. As shown, the preferred slide is a vertically elongated member of C-shaped cross section having its back portion engaged on the flange 39 and its forward portion extending away from the flange 39. The slides 45 have pivoting linkages including a clevis 47 fixed to the slide 45, a bracket 49 fixed to the stern end of the tank 11 or 13 and a link 51 pivotally connected at pins 53 and 55 to the clevis 47 and the bracket 49, respectively. Most preferably, the link 51 is elastomeric. The slides 45 and their linkages limit movement of the flotation platform away from the parallel plane 17 or sea wall S and away from the vertical perpendicular plane 15 while permitting the stern ends of the tanks to reciprocate vertically in unison along the flanges 39 of the guide members 19 and 21. The pivoting action and elastomeric quality of the link 51 allow the bow and stern ends of the lift to reciprocate independently and absorb the stresses which occur during operation of the lift L while facilitating the vertical reciprocation of the tanks in unison. Alternatively, the I-beam may be fixed to the float and the slides 45 fixed to the dock or sea wall and still be in keeping with the principles of the invention.

Figure 9:
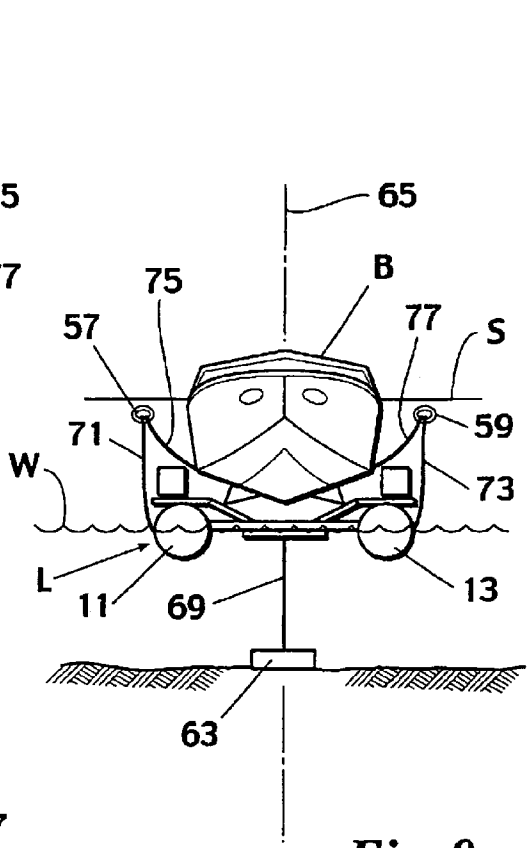
FIG. 9 is a front elevation view of the lift and boat of FIG. 7.
Figure 7:
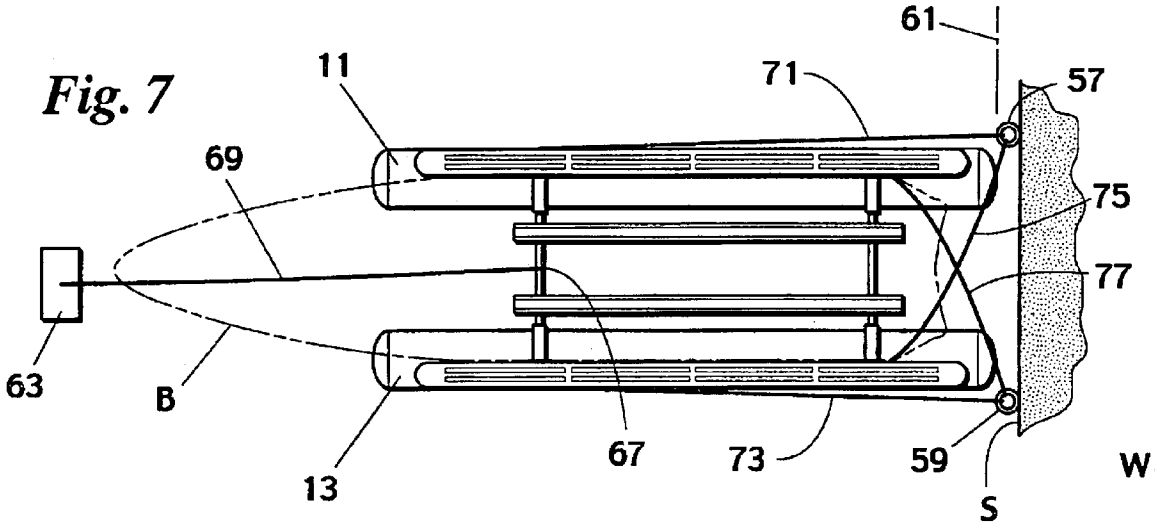
FIG. 7 is a top plan view of another preferred embodiment of the stern-on lift with a boat on the lift.
Figure 8:
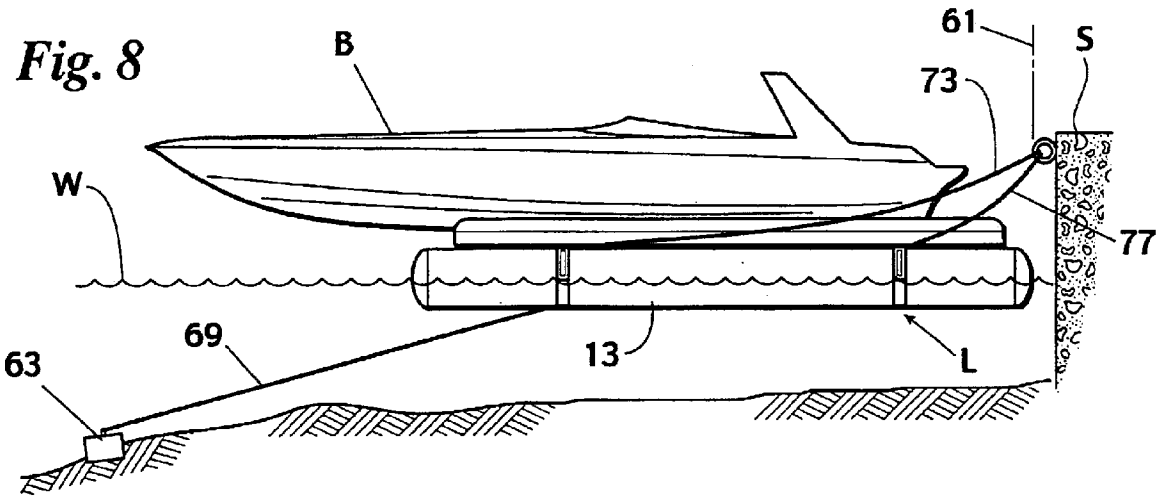
FIG. 8 is a side elevation view of the lift and boat of FIG. 7.

Turning now to FIGS. 7–9, an alternative embodiment of the stern-on lift L is illustrated. The guides 19 and 21 consist of horizontally spaced rings 57 and 59 fixed to the sea wall Sand extending from the sea wall S to the vertical plane 61 parallel to the sea 2 wall S. The anchor 63 is disposed on the sea floor forward of the tanks 11 and 13 substantially aligned on the perpendicular plane 65 extending through the midpoint 67 between the tanks 11 and 13 and the rings 57 and 59. A line 69 connects the anchor 63 to the bow portion of the platform at substantially the midpoint 67 and limits movement of the platform toward the parallel plane 61 or sea wall S and away from the perpendicular plane 65 or laterally in relation to the sea wall S. A pair of lines 71 and 73 are connected between each of the rings 57 and 59 and the bow end of corresponding ones of the tanks 11 and 13. The bow lines 71 and 73 limit movement of the platform away from the parallel plane 61 or dock S and away from the perpendicular plane 65 or along the sea wall S while permitting the stern ends of the tanks 11 and 13 to reciprocate vertically in unison along the sea wall S or parallel plane 61. A second pair of lines 75 and 77 connecting the rings and the stern ends of opposite ones of the tanks 11 and 13 or of opposite sides of the boat B may be used to limit movement of the stern end of the platform away from the parallel plane 61 or sea wall S and away from the perpendicular plane 65 or laterally along the sea wall S but only when the lift is not in operation. During operation of the lift the second pair of lines 75 and 77 must be cast off.

In operation, with a boat B elevated out of the water W by the lift L as shown in FIGS. 2 and 8, as water is introduced into the stern end of the tanks 11 and 13 and air is evacuated from the front end of the tanks 11 and 13, the stern ends of the tanks 11 and 13 will first be lowered in unison into the water W. In the track embodiment of FIGS. 1 through 6, the tracks or flanges 39 and slides 45 restrict lateral motion of the tanks 11 and 13 and longitudinal motion of the tanks 11 and 13 while permitting the tanks 11 and 13 to reciprocate in unison vertically. The pivoting elastomeric links 51 allow the stern ends of the tanks 11 and 13 to reciprocate independently of the bow ends of the tanks 11 and 13 to absorb external stresses applied to the lift components. In the ring embodiment of FIGS. 7–9, the stern lines 75 and 77 will have been cast off before beginning operation of the lift. The bow lines 71 and 73 limit lateral and forward motion of the tanks while the line 69 connected to the anchor 63 limits rearward motion of the tanks. The bow lines 71 and 73, however, permit vertical motion of the stern ends of tanks 11 and 13 in unison with respect to the parallel plane 61 or sea wall S. In either embodiment, when the stern ends of the tanks 11 and 13 are fully lowered to the level limited by the floats 29 and 31 on the sides of the lift L, the bow portions of the tanks 11 and 13 also fill with water, causing the lift L to come to a level condition, as is best seen in FIG. 3. In this lowered condition, the boat B is supported solely by the water W and is ready to be launched. In redocking the boat B, the boat B is backed onto the lift L in its fully lowered condition. The hydropneumatic process is then reversed, causing the bow end of the lift L to be raised initially, followed by the stern end of the lift L until the hull of the boat B is entirely out of the water W.

Thus, it is apparent that there has been provided, in accordance with the invention, a stern-on boat lift that fully satisfies the objects, aims and advantages set forth above. While the invention has been described in conjunction with a specific embodiment thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A lift for mooring a boat stern-on to a sea wall comprising:

a pair of elongated horizontally spaced guide members fixed to the sea wall and extending from the sea wall in stationary relationship along a Vertical plane parallel to the sea wall;

a flotation platform having a pair of substantially parallel hydro-pneumatic buoyancy tanks symmetrically spaced from a vertical plane perpendicular to said parallel plane and extending substantially midway between said guide members and a frame fixed to said tanks for supporting a hull of the boat with a keel of the boat substantially aligned with said perpendicular plane and a stern of the boat at a stern end of said platform, said stern end of said platform being closer to said parallel plane; and means connecting a stern end of each of said tanks to said guide members for limiting movement of said platform away from said parallel plane and away from said perpendicular plane and for permitting said stern ends of said tanks to move vertically in unison along said guide members.

2. A lift according to claim 1, said connecting means further comprising a pivoting linkages, one connected between each of said guide members and its corresponding said tank, permitting independent angular displacement in a vertical plane of said tanks relative to said guide members and restricting lateral displacement of said tanks relative to said guide members.

3. A lift for mooring a boat stern-on to a sea wall comprising:

a pair of horizontally spaced vertical tracks fixed proximate an upper end thereof to the sea wall and extending from the sea wall to a vertical plane parallel to the sea wall;

a flotation platform having a pair of substantially parallel hydro-pneumatic buoyancy tanks symmetrically spaced from a vertical plane perpendicular to said parallel plane and extending substantially midway between said tracks and a frame fixed to said tanks for supporting a hull of the boat with a keel of the boat substantially aligned with said perpendicular plane and a stern of the boat at a stern end of said platform, said stern end of said platform being closer to said parallel plane; and a pair of slides, one fixed at one end to a stern end of each of said tanks and engaged and riding at another end on one of said tracks for limiting movement of said platform away from said parallel plane and away from said perpendicular plane while permitting said stern ends of said tanks to reciprocate vertically in unison along said tracks.

4. A lift according to claim 3, each of said slides having a pivoting linkage permitting angular displacement in a vertical plane of said tanks relative to said tracks and restricting lateral displacement of said tanks relative to said tracks.

5. A lift according to claim 4, each said pivoting linkage comprising a clevis fixed to said slide, a bracket fixed to said tank and a link pivotally connected at one end to said clevis and at another end to said bracket.

6. A lift according to claim 5, each said link being formed from elastomeric material.

7. A lift according to claim 3, said tracks being I-beams having webs disposed along a common plane, said slides being members of C-shaped cross-section slidably engaged on a flange of said I-beams and having a pivoting linkage permitting angular displacement in a vertical plane of said tanks relative to said tracks and restricting lateral displacement of said tanks relative to said tracks.

8. A lift according to claim 3, further comprising an anchor disposed on a floor of the sea forward of said tanks and substantially aligned on said perpendicular plane; and a line connecting said anchor to a bow portion of said platform at substantially a mid-point between said tanks for limiting movement of said platform toward said parallel plane and away from said perpendicular plane.

* * * * *